United States Patent [19]

Inanaga et al.

[11] 4,176,249

[45] Nov. 27, 1979

[54] DELETERIOUS MECHANICAL VIBRATIONS FROM DYNAMIC LOUDSPEAKER OFFSET BY ADDITIONAL DYNAMIC DEVICE

[75] Inventors: Kiyofumi Inanaga; Saburo Egawa, both of Tokyo; Akio Shimizu, Niiza; Keijiro Maeda, Yokohama, all of Japan

[73] Assignee: Sony Corporation, Tokyo, Japan

[21] Appl. No.: 927,007

[22] Filed: Jul. 24, 1978

[30] Foreign Application Priority Data

Jul. 25, 1977 [JP] Japan ..... 52-88351

[51] Int. Cl.[2] ..... H04R 9/06

[52] U.S. Cl. ..... 179/1 E; 179/115.5 DV; 179/180

[58] Field of Search ..... 179/1 E, 115.5 R, 115.5 DV, 179/115.5 PS, 116, 180

[56] References Cited

U.S. PATENT DOCUMENTS

| | | | |
|---|---|---|---|
| 2,832,843 | 4/1958 | Miessner | 179/180 |
| 4,109,116 | 8/1978 | Victoreen | 179/107 E |

*Primary Examiner*—George G. Stellar

*Attorney, Agent, or Firm*—Hill, Van Santen, Steadman, Chiara & Simpson

[57] ABSTRACT

A dynamic loudspeaker comprises first and second device means each having a coil disposed in a magnetic gap formed in a magnetic circuit, a vibratory member driven by a first drive means, and a massive member opposingly disposed to the vibratory member and being driven by a second drive means, whereby reaction force generated by said vibratory member is substantially eliminated by reaction force of said massive member.

11 Claims, 5 Drawing Figures

DELETERIOUS MECHANICAL VIBRATIONS FROM DYNAMIC LOUDSPEAKER OFFSET BY ADDITIONAL DYNAMIC DEVICE

BACKGROUND OF THE INVENTION

1. Field of the Invention:

This invention relates to a dynamic loudspeaker, and more particularly, to such a dynamic loudspeaker which may offset a reaction force generated by a diaphragm by a reaction force of a massive member being driven.

2. Description of the Prior Art:

Usually, a loudspeaker comprises a magnetic circuit formed by a magnet, a pole, a plate, and a yoke, a cone-shaped vibratory member having a voice coil disposed in an air gap of the magnetic circuit, and a support member for supporting the vibratory member, wherein the vibratory member vibrates in response to aural signals supplied to the voice coil. The loudspeaker is utilized by mechanically supporting the magnetic circuit and by securing a frame supporting the vibratory member to a baffle plate of a speaker box or an enclosure.

When the vibratory member of such loudspeaker is driven to vibrate in the forward or rearward direction, a reaction force acts in the rearward or forward direction to vibrate the magnetic circuit. Vibrations generated in the magnetic circuit will be transmitted to the baffle plate through the frame, thus the baffle plate will also vibrate. Vibrations of the magnetic circuit and the baffle plate have serious effects on tone quality of aural outputs generated by the vibratory member and deteriorate the tone quality of aural outputs.

For preventing vibrating of the magnetic circuit and the like caused by reaction force generated in driving the vibratory member, it is known to sufficiently increase the weight of the magnetic circuit and the like as compared with that of the vibratory member and the voice coil, however, when the weight of magnetic circuit and the like is increased to substantially overcome the reaction force, there are problems in practical use such as difficulties in assembling or transporting the loudspeaker which is not preferable for the construction of loudspeakers of the usual type. Further, the baffle board or the enclosure mounting the speaker is usually formed of a high quality material to prevent vibrations thereof, thus, the enclosure is expensive.

In a speaker system comprising a vibratory member of a first speaker being disposed in an opening of the enclosure, and a second speaker disposed opposingly with the first speaker and in the enclosure, reaction force of the first speaker can be absorbed by the second speaker. However, acoustic pressure from the second speaker will act on the enclosure in such speaker system, even though it is possible to suppress vibrations in magnetic circuit of the first speaker, vibrations will occur in the enclosure, and acoustic waves generated from the first speaker will interfere with acoustic waves generated from vibrations of the enclosure, as the results, it is difficult to obtain clear play back sounds.

SUMMARY OF THE INVENTION

An object of the present invention is to provide a novel loudspeaker improving shortcomings in prior art loudspeakers.

Another object of the present invention is to provide a loudspeaker wherein a magnetic circuit giving driving force on a vibratory member is combined with a massive member which is driven in the direction opposite to the vibrations of the vibratory member so as to offset reaction force caused from the vibratory member.

Still another object of the present invention is to provide a loudspeaker wherein reaction force caused by vibrations of vibratory member is eliminated for emitting clear sounds.

A further object of the present invention is to provide a loudspeaker wherein a non-sound producing massive member moving in the direction opposite to the moving direction of the vibratory member is provided in the magnetic circuit, whereby sounds generated by the vibratory member are emitted in high fidelity since any sounds will not be generated from the massive member.

A still further object of the present invention is to provide a loudspeaker wherein vibrations of the magnetic circuit, and the frame and the enclosure supporting the magnetic circuit are prevented so as to reproduce clear sounds.

A further object of the present invention is to provide a loudspeaker having in a magnetic circuit a massive member moving in the direction opposite to moving direction of a vibratory member to suppress reaction force of the vibratory member thus reducing the size of the frame.

A further object of the present invention is to provide a loudspeaker effectively preventing vibrations of enclosure without utilizing a material of high qualiy for the enclosure.

A still further object of the present invention is to provide a dynamic loudspeaker comprising a diagram having a voice coil, first drive means for driving the diaphragm to originate sounds, a massive member vibratably coupled to first driven means, and second drive means for vibrating the massive member so as to eliminate reaction force generated by the diaphragm.

BRIEF DESCRIPTION OF THE DRAWINGS

These and other objects, effects and advantages of the present invention will be clarified from the following description taken in conjunction with attached drawings exemplifying some preferred embodiments of the present invention, in which.

DETAILED DESCRIPTION OF THE EMBODIMENTS

Figure 1:
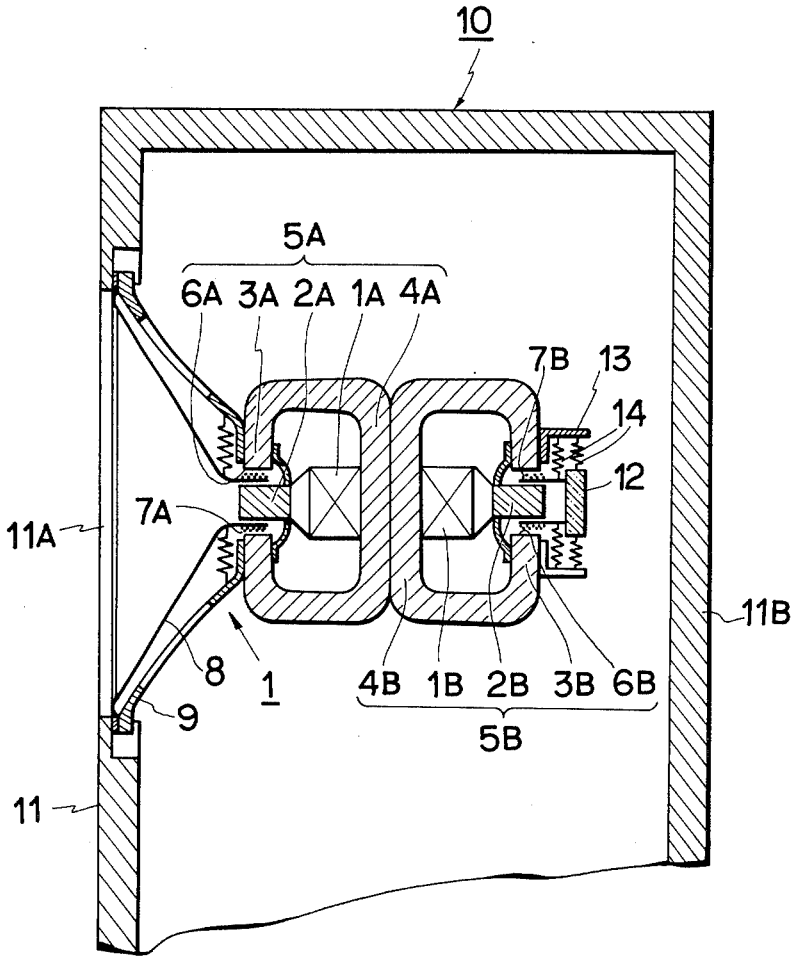
FIG. 1 is a sectional view showing construction of a dynamic loudspeaker with an enclosure exemplifying the present invention.

FIG. 1 is a sectional view of a loudspeaker with enclosure according to the present invention. In the drawing, a speaker unit 1 is formed mainly of a magnetic circuit 5A, a cone-shaped diaphragm 8 and a frame 9.

More particularly, the magnetic circuit 5A includes a permanent magnet 1A, a pole 2A, a plate 3A, and a yoke 4A, and an air gap 6A is defined at given spacings from pole 2A and pole 2B therebetween. The diaphragm 8 constituting a vibratory member is secured at one end thereof with the front end of the frame 9 through an edge member, and a voice coil 7A wound around a bobbin is disposed in the air gap 6A and mounted on the other end of the vibratory member 8. The magnetic circuit 5A is secured to a front panel of an enclosure 10 or a baffle plate 11 having an opening 11A by means of screws or the like (not shown) and through the frame 9. Incidentally, the rear side of enclosure 10 is closed by a rear surface baffle board 11B. As is well known for those skilled in the art, when an aural current is supplied to voice coil 7A in such loudspeaker system the vibratory member 8 displaces in the left and right-ward directions as viewed in FIG. 1 to emit acoustic waves to the outside of the enclosure through the opening 11A. Such speaker system is publicly known.

According to the first embodiment of the present invention, the loudspeaker shown in FIG. 1 further comprises a second magnetic circuit 5B including, similar to the first magnetic circuit 5A driving the vibratory member 8, a magnet 1B, a pole 2B, a plate 3B, and a yoke 4B, and being rigidly secured to the rear surface of the first magnetic circuit 5A by a bonding agent or the like. A second drive means is formed of a movable coil 7B disposed in an air gap 6B defined in the second magnetic circuit 5B at a position axially aligning with respect to the air gap 6A in the first magnetic circuit 5A. The movable coil 7B is coupled to a massive member 12 and is driven in the direction opposite to the vibratory member 8. The massive member 12 is secured to the movable coil 7B and is suspending and thereby supported through a damper 14 on a supporting plate 13 which is mounted on the plate 3B of second drive means 5B.

The massive member 12 is driven by a second drive means at a force substantially equal to reaction force of the vibratory member 8 which is driven by the first drive means in response to aural current supplied to the voice coil 7A, since a portion of the aural current supplied to the voice coil 7A is also supplied to the movable coil 7B so as to move the massive member 12 in the direction opposite to the displacement of the vibratory member. By determining the density of magnetic flux in the magnetic circuit 5B, the amount of air gap 6B, the weight of the massive member 12 and the like in the second drive means, suitably, it is possible to drive the massive member 12 by the second drive means at a force substantially equal to reaction force of the vibratory member 8 generated in driving the same, wherein aural or acoustic current supplied to the movable coil 7B can be sufficiently reduced as compared with acoustic current supplied to the voice coil 7A. Further, by forming the massive member 12 of a material having a large specific gravity such as iron or lead, it is possible to prevent sounds generating from the massive member.

In the embodiment, reaction force, generated in driving the vibratory member 8 by the first drive means consisting of the magnetic circuit 5A, can be compensated by the reaction force generated in driving the massive member 12 by the second drive means consisting of the magnetic circuit 5B, and thus, any substantial reaction force will not act on magnetic circuits 5A and 5B, whereby any effects (or vibrations) of the reaction forces will not be observed in magnetic circuit 5A and 5B in driving the vibratory member 8. Thus, vibrations will not be generated in the frame 9 mechanically supporting the magnetic circuit 5A and 5B thereon, and also in the baffle plate 11 of the speaker box 10 securing the frame 9. Therefore, it is possible to eliminate vibrations from magnetic circuits and the like, and to obtain acoustic output of very good tone quality from the vibratory member 8.

Figure 3:
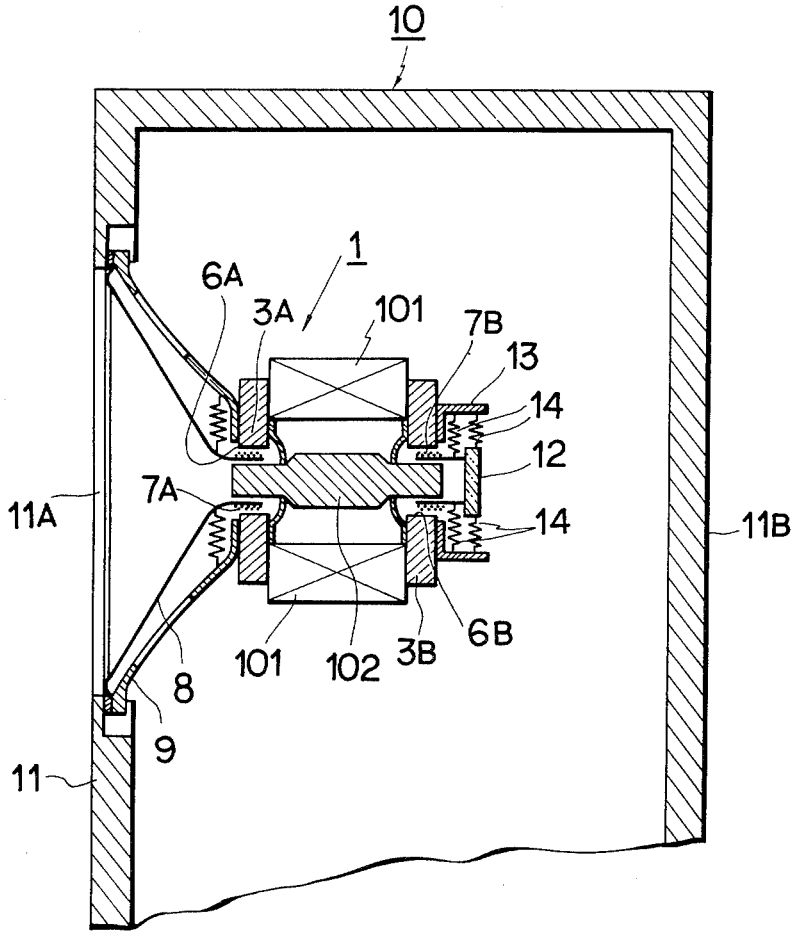
FIG. 3 is a sectional view showing construction of a loudspeaker according to a third embodiment of the present invention wherein a magnetic circuit of external magnetic type is commonly provided in a first and a second drive means.
Figure 4:
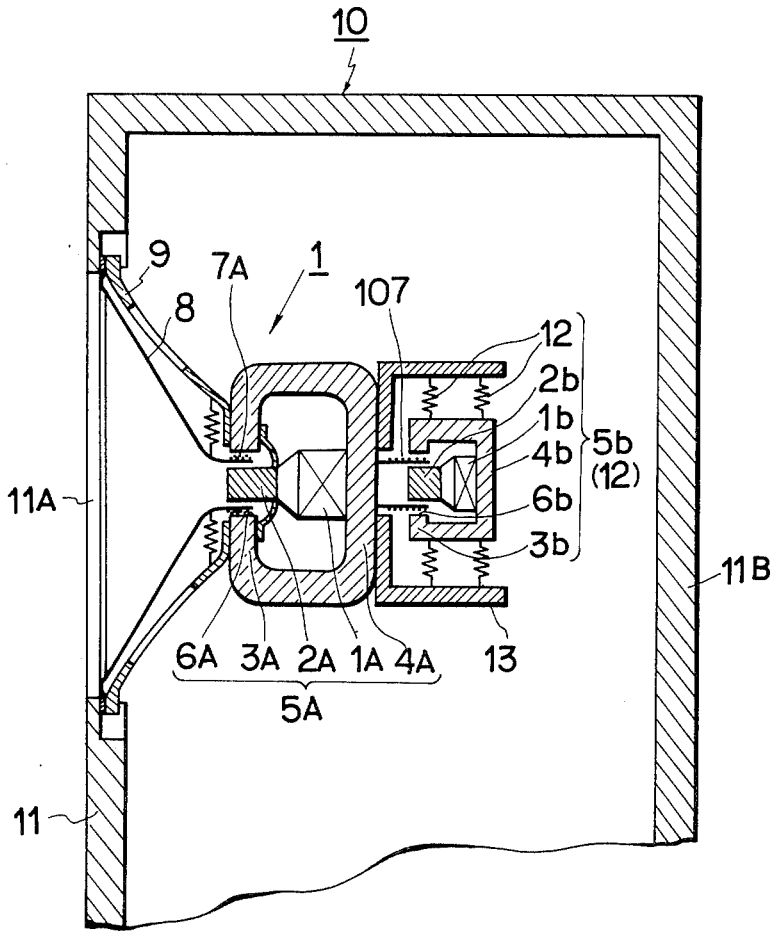
FIGS. 4 and 5 are sectional views of loudspeakers according to fourth and fifth embodiments of the present invention respectively, wherein second drive means comprises a massive member being movably constituted.

In the embodiment, magnetic circuits 5A and 5B constituting first and second drive means are formed of internal magnet type, but it is possible to obtain similar results from magnetic circuits of external magnet type. Further, respective drive means in the drawing are constituted of separate magnetic circuits 5A and 5B secured integrally in the opposite directions, but the magnetic circuits may jointly constituted as shown in FIGS. 3 and 4.

In the embodiments described hereafter, parts corresponding to the embodiment of FIG. 1 carry the same numeral in the drawings, and a description will only be given with respect to the portion of different constitution.

Figure 2:
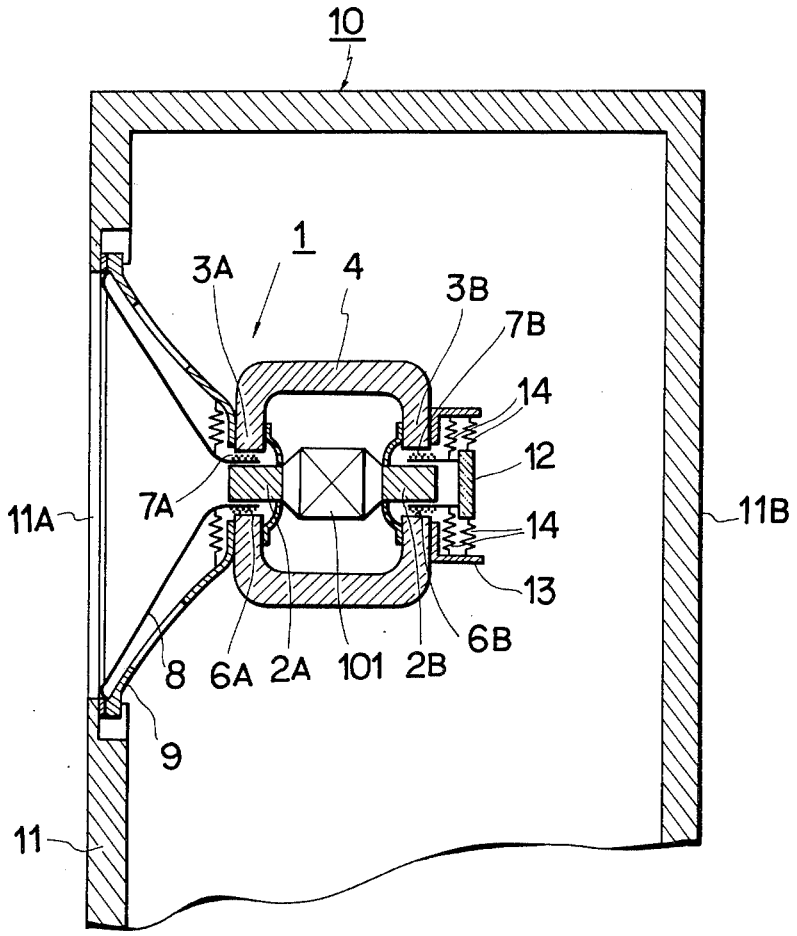
FIG. 2 is a sectional view showing a second embodiment of the present invention wherein first and second drive means jointly have a magnetic circuit of internal magnet type.

FIG. 2 is a sectional view of an embodiment of the present invention wherein first and second drive means jointly have a magnetic circuit of internal magnet type.

In a loudspeaker shown in FIG. 2, first and second drive means are constituted by jointly having a magnetic circuit of internal magnet type comprising a single magnet 101 having poles 2A and 2B secured on opposite magnetic pole surfaces, a plate 3A defining an air gap 6A between one pole 2A, a plate 3B defining an air gap 6B between the other pole 2B, and a yoke 4 coupled thereto. Since respective drive means are constituted by jointly providing a magnetic circuit, it is possible to omit securing operation in the first embodiment for securing separate drive means one another in the opposite directions, and to reliably align the direction of reaction forces generated in driving the vibratory member 8 and the massive member 12 by respective drive means. Similar to the first embodiment, it is possible to eliminate vibrations from magnetic circuits and the like, and to obtain acoustic output of very good tone quality from the vibratory member 8 of the embodiment.

FIG. 3 is a sectional view of an embodiment of the present invention wherein first and second drive means are constituted by jointly providing a magnetic circuit of external magnet type.

In the embodiment of FIG. 3, first and second drive means are constituted by jointly providing a magnetic circuit of external magnet type wherein a plate 3A defining an air gap 6A around side peripheral surface of one end of a rod-shaped pole 102, a plate 3B defining an air gap 6B around side peripheral surface of the other end of the pole 102, and a magnet 101 coupling the plates. Similar effects can be obtained from the embodiment as similar to the second embodiment.

Further, in the embodiments described heretofore, second drive means is constituted of movable coil 7B, but the coil 107 in the second drive means may be fixed with the magnetic circuit 5b being movable.

FIG. 4 is a sectional view of an embodiment of the present invention wherein second drive means is constituted of a magnetic circuit 5b of internal magnet type which is movably disposed.

In the embodiment of FIG. 4, a coil 107 of second drive means is secured on a yoke 4A securing thereon a magnet 1A in first drive means for driving a vibratory member 8 at the position opposite to the magnet 1A.

The second drive means is constituted of a magnetic circuit 5b formed of a magnet 1b, a pole 2b, a plate 3b and a yoke 4b, and a supporting plate 13 suspendingly supporting the magnetic circuit 5b through a damper 14 (see FIG. 3), such that the coil 107 thereof is located in an air gap 6b defined in the magnetic circuit 5b.

In the embodiment having the construction as described heretofore, when aural current is supplied to the voice coil 7A in first drive means and also to the coil 107 in second drive means, the magnetic circuit 5b is driven to vibrate in the direction opposite to that of vibratory member 8 driven by first drive means. Thus, the magnetic circuit 5b in the embodiment acts in itself as the massive member 12 in the first embodiment. Therefore, it is possible to omit massive member 12 provided separately from second drive means in the preceding embodiments, thereby, reducing the number of parts and saving manufacturing costs, while obtaining acoustic output of very good tone quality from the vibratory member 8.

Figure 5:
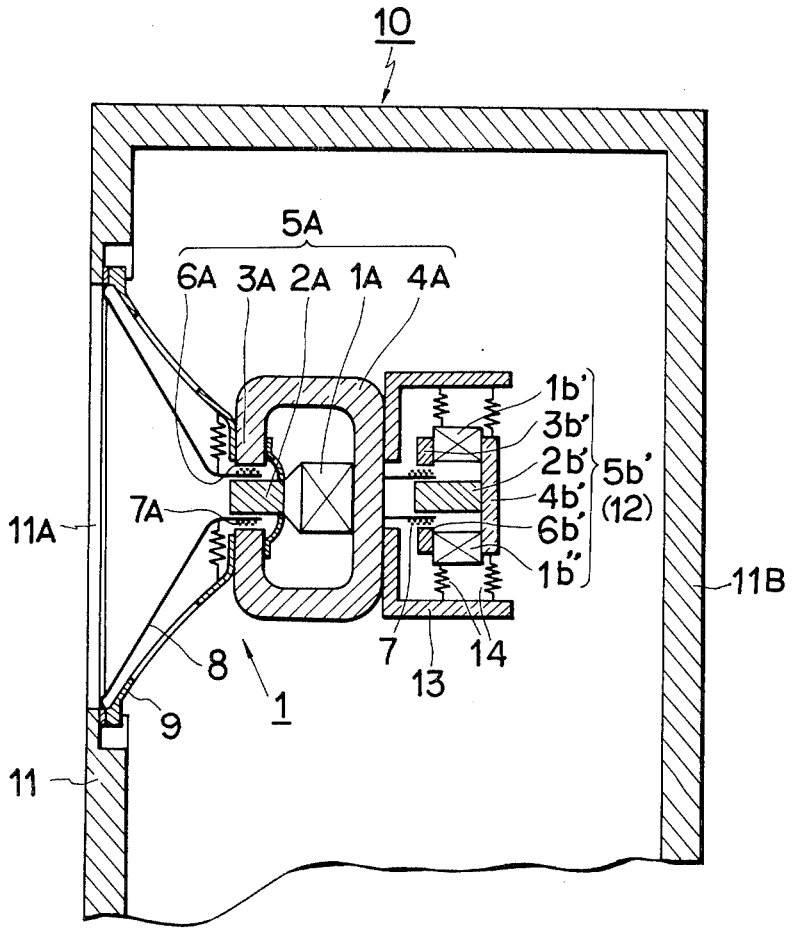

In the embodiment of FIG. 5, a magnetic circuit 5b in second drive means is formed of external magnet type having a magnet 1b', a pole 2b', a plate 3b' and a yoke 4b', and the circuit is suspendingly supported on supporting plate 13 through a damper 14 so as to act as massive member 12. A stationary coil 107 is provided in an air gap 6b' of the magnetic circuit 5b' to drive the same in the direction opposite to the vibratory plate 8. It is possible to obtain effects similar to the embodiment of FIG. 4.

In loudspeakers having the construction as described heretofore with reference to embodiments of the present invention, reaction force generated in driving the vibratory member 8 by first drive means can be offset by reaction force generated in driving a massive member 12 or a magnetic circuit by second drive means, thus, any effect will not be applied on magnetic circuits, a frame or baffle plate or the like supporting the magnetic circuits, whereby acoustic output of very good tone quality can be obtained.

It may be possible to provide a vibratory plate as the massive member 12 and to vibrate the plate by second drive means as described in the embodiments, but in such a case, acoustic output emitted from the vibratory plate in the enclosure will have bad effects on acoustic output of the vibratory member 8 driven by first drive means and, therefore, the massive member 12 should not be provided with the object of acoustic output.

As described heretofore, the loudspeaker according to the present invention comprises first and second drive means having a coil disposed in air gap or magnetic gap defined in a magnetic circuit, a vibratory member driven by a first drive means, and a massive member driven by a second drive means in the direction opposite to the vibratory member, whereby reaction force generated in driving the vibratory member is substantially offset by a reaction force generated in driving the massive member, thus, the magnetic circuit in the first drive means for driving the vibratory member will not be vibrated by the effect of the reaction force generated in driving the vibratory member, and any vibration will not generate in the frame or baffle plate supporting the magnetic circuit. Therefore, it is possible to eliminage vibrations from magnetic circuits and the like, and to obtain acoustic output of very good tone quality.

While the present invention has been described herein with reference to certain exemplary embodiments thereof, it should be understood that various changes, modifications and alterations may be effected, without departing from the spirit and the scope of the present invention, as defined in the appended claims.

We claim as our invention:

1. A dynamic loudspeaker comprising a diaphragm having a voice coil, first drive means for driving said diaphragm to originate sounds, a massive member vibratably coupled to said first drive means, and second drive means for vibrating said massive member so as to eliminate reaction force generated by said diaphragm.

2. A dynamic loudspeaker as set forth in claim 1, wherein said first drive means comprises a first magnetic circuit having a first air gap, said voice coil of said diaphragm being disposed in said air gap, said second drive means comprises a second magnetic circuit having a second air gap, a moving coil formed integrally with said massive member being disposed in said second air gap, and said first and second magnetic circuits being rigidly and mechanically secured with one another.

3. A dynamic loudspeaker as set forth in claim 2, wherein said second magnetic circuit further comprises a support portion on which said massive member is supported through a damper.

4. A dynamic loudspeaker as set forth in claim 1, wherein said first and second drive means comprise a common magnetic circuit having first and second air gaps at corresponding positions, said voice coil of said diaphragm being disposed in said first air gap, and a moving coil mounted on said massive member being disposed in said second air gap.

5. A dynamic loudspeaker as set forth in claim 4, wherein said massive member is supported on said magnetic circuit through a damper.

6. A dynamic loudspeaker as set forth in claim 1, wherein said massive member is a magnetic circuit having an air gap and a coil disposed in said air gap, and said coil is secured to said first drive means.

7. A dynamic loudspeaker as set forth in claim 6, wherein said magnetic circuit is supported on said first drive means through a damper.

8. A dynamic loudspeaker as set forth in claim 6, wherein said magnetic circuit comprises a permanent magnet and a yoke.

9. A dynamic loudspeaker as set forth in claim 1, wherein said first drive means comprises a permanent magnet, a yoke and an air gap receiving a coil of said diaphragm therein, said second drive means comprises a permanent magnet, a yoke, an air gap receiving a coil of said massive member therein, and said air gaps are located on an equal axial line.

10. A dynamic loudspeaker as set forth in claim 1, wherein said first drive means comprises a permanent magnet, a yoke, and an air gap receiving a voice coil of said diaphragm therein, said massive member is constituted of a magnetic circuit having a permanent magnet and a yoke, said magnetic circuit having an air gap receiving a coil for driving said magnetic circuit, and said two air gaps are located on an equal axial line.

11. A dynamic loudspeaker comprising a diaphragm positioned at an opening formed in an enclosure, drive means for driving said diaphragm to originate sounds to the exterior of said enclosure, means coupled to said drive means and having a vibratable massive member disposed in said enclosure, and means for vibrating said massive member in opposite direction from the vibrating direction of said diaphragm, whereby a reaction force generated by said diaphragm is eliminated by a vibration force generated by said last mentioned means.

* * * * *